US007635160B2

(12) United States Patent
Figueras Mitjans

(10) Patent No.: US 7,635,160 B2
(45) Date of Patent: Dec. 22, 2009

(54) CHAIR AND TABLE FOR CONFERENCE HALLS AND SIMILAR

(75) Inventor: Jose Figueras Mitjans, Llica D'Amunt (ES)

(73) Assignee: Figueras International Seating S.A., Llica D'Amunt (Barcelona) (ES)

( * ) Notice: Subject to any disclaimer, the term of this patent is extended or adjusted under 35 U.S.C. 154(b) by 61 days.

(21) Appl. No.: 11/912,654

(22) PCT Filed: Apr. 25, 2006

(86) PCT No.: PCT/ES2006/000202

§ 371 (c)(1),
(2), (4) Date: Dec. 14, 2007

(87) PCT Pub. No.: WO2006/114463

PCT Pub. Date: Nov. 2, 2006

(65) Prior Publication Data

US 2008/0211268 A1 Sep. 4, 2008

(30) Foreign Application Priority Data

Apr. 26, 2005 (ES) ..... 200501001

(51) Int. Cl.
*A47B 39/08* (2006.01)
*A47B 83/02* (2006.01)

(52) U.S. Cl. ..... 297/163; 297/169; 297/170; 297/173

(58) Field of Classification Search ..... 297/163, 297/164, 170, 165, 167, 169, 172, 173
See application file for complete search history.

(56) References Cited

U.S. PATENT DOCUMENTS

| | | | | |
|---|---|---|---|---|
| 3,336,076 | A | 8/1967 | Malitte | |
| 4,072,346 | A | 2/1978 | Schueler et al. | |
| 4,431,231 | A | 2/1984 | Elazari et al. | |
| 4,925,256 | A * | 5/1990 | Vargas et al. | 297/163 |
| 7,469,966 | B1 * | 12/2008 | Vallee | 297/163 |

FOREIGN PATENT DOCUMENTS

| | | | |
|---|---|---|---|
| AU | 4437372 | A | 1/1974 |
| ES | 1026418 | A | 4/1994 |
| ES | 1043884 | A | 1/2000 |
| ES | 1044217 | A | 3/2000 |
| ES | 1044964 | A | 7/2000 |
| ES | 1044968 | A | 7/2000 |

* cited by examiner

*Primary Examiner*—Anthony D Barfield
(74) *Attorney, Agent, or Firm*—Lucas & Mercanti, LLP

(57) ABSTRACT

The invention relates to an armchair and table for conference halls and the like, comprising a backrest (3) that can be lowered over the seat (2) in combination with the movement of a table board (6) that can swivel between a vertical position and a horizontal position, the board (6) being on a column (5) with a variable height which is fastened on the structure of the armchair by means of a ball joint anchor (16), insofar as the board (6) can move forwards in the position for use, determining an antipanic arrangement.

6 Claims, 13 Drawing Sheets

CHAIR AND TABLE FOR CONFERENCE HALLS AND SIMILAR

FIELD OF THE INVENTION

The present invention relates to the armchairs arranged in halls intended for work meetings, such as congresses, conferences, etc, providing for that purpose an armchair provided with equipment making it particularly advantageous for the use in the mentioned application.

STATE OF THE ART

Armchairs are known that are provided with lecterns or small boards incorporated at the side or on the armrest in a swiveling movement which allows placing said lectern boards unfolded in a position for use or folded in an inoperative position in order to clear the space in front of the corresponding armchair.

The lectern boards arranged in conventional armchairs have a small size, therefore they are useful for taking notes or supporting books and reference notebooks, but they are completely insufficient for making drawings, plans or tasks requiring more space.

Furthermore, in meetings of the type of conferences or the like, the participation of the attendees generally requires their intervention from the position that they occupy, for which the armchairs need to be equipped with acoustic communication means, as well as a suitable installation for electrical and computer connections, etc.

OBJECT OF THE INVENTION

An armchair is proposed according to the invention which is provided with features making it particularly advantageous for the function of the use in meetings of congresses, conferences, etc., incorporating equipment which allows developing, in a practical manner, all the necessary activities for the intervention of the users from the armchairs themselves.

This armchair object of the invention comprises a structural assembly incorporating a backrest that can be lowered over the seat, a column being linked to the rear part of a side, on which column there is incorporated a table board in an articulated assembly, which table board can swivel between a horizontal position for use and a vertical folded position behind the backrest.

The table board is attached to an actuation mechanism formed by a series of articulated connecting rods, there being provided a shock absorbing cylinder that can determine two stable provisional positions on both sides of a rotation point on which the articulation of the mechanism is established by means of a common shaft with the rotating assembly of the backrest.

In this manner, the swiveling movement of the table board is linked to the swiveling movement of the backrest, such that when the backrest is lowered over the seat, the table board rises to the horizontal position behind the armchair and when the backrest rises to the position for use, the table board is lowered to the vertical folded position.

The table board is incorporated in a sliding assembly on the support for the attachment to the articulated assembly, being able to slide backwards in the position for use, so as to be in a more comfortable location for the user from a rear armchair, incorporating a retaining shock absorbing device maintaining the stability of the placement.

This arrangement allows the board to be moved forwards by a simple push, determining an antipanic quality because the user only has to push the board to clear the space in front of his/her seat armchair in order to leave without obstructions.

The column bearing the table board is assembled on the structure of the armchair by means of a ball joint anchor, by means of which the column can be positioned so that the board is horizontal in the position for use, independently of the seating of the armchair on the floor.

The mentioned column bearing the table board can be substituted by others of a different height, which allows adapting the height of the table board to the location of the rear armchairs in distributions on stepped floors.

The incorporation of the table board on the bearing column can be established either centered or moved towards a side, allowing the incorporation of the armchair both in distributions of rows with the armchairs correspondingly aligned one behind the other, or in distributions of rows with the armchairs in a staggered formation.

A wiring installation with electrical, computer connection elements etc. is incorporated in the armchair, being able to incorporate an individual lighting system, as well as acoustic communication means and any other type of means that may be necessary for the intervention of the users from their position, with an automatic disconnection arrangement by means of the movement of the table board.

The armchair of the invention thus has features providing it with its own identity and a preferred character with respect to the conventional armchairs of the same application.

DETAILED DESCRIPTION OF THE INVENTION

The object of the invention relates to an armchair intended for conference halls or similar applications, including an equipment allowing the users to carry out all the necessary actions for the participation in this type of activities.

The armchair consists of a general structure (1), in which a seat (2) and a backrest (3) are arranged, the latter being in a rotating assembly on a shaft (4), with the possibility of swiveling between the normal raised position and a lowered position over the seat (2).

Figure 1:
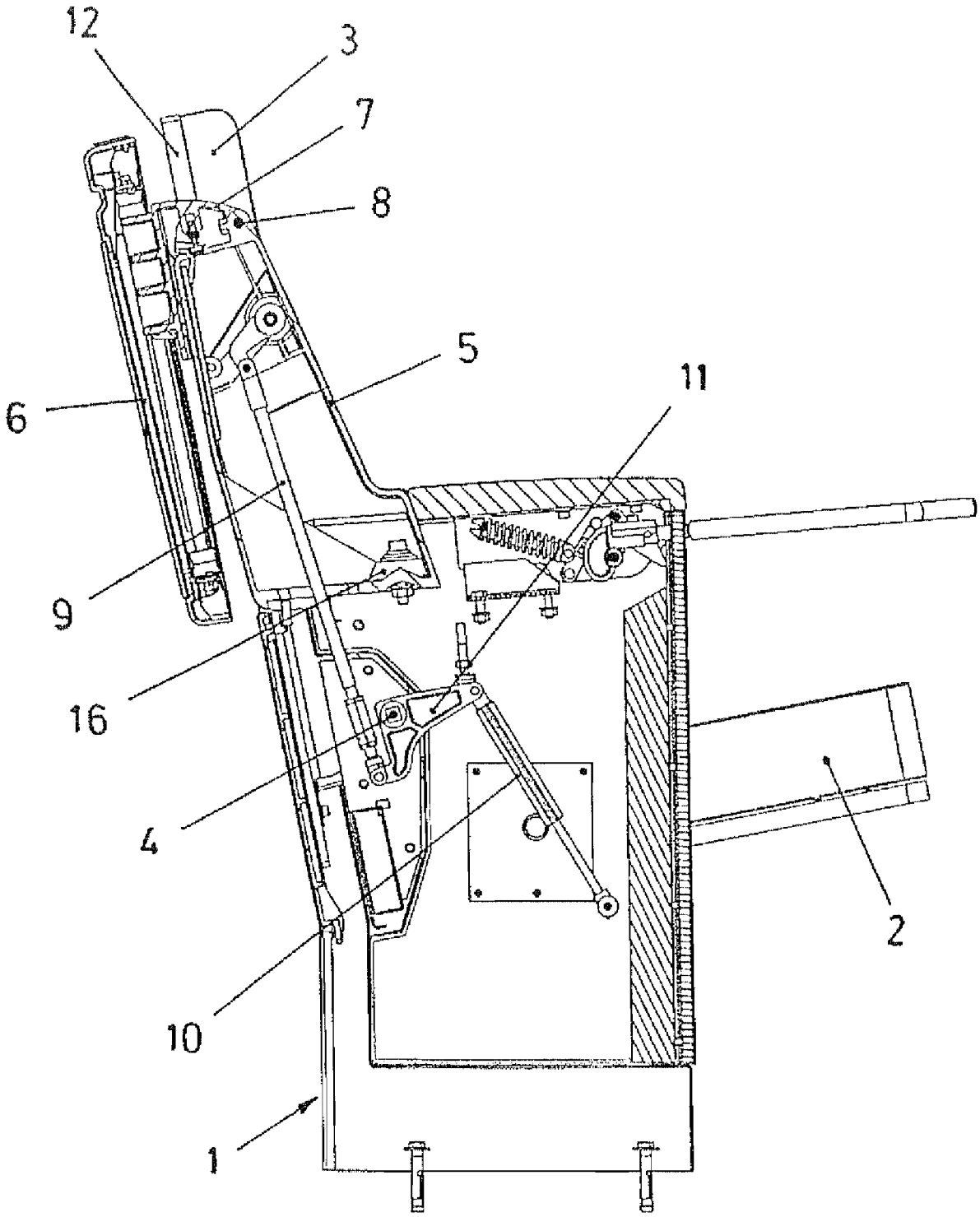
FIG. 1 shows a sectioned side view of the armchair of the invention, with the table board in the folded position.
Figure 2:
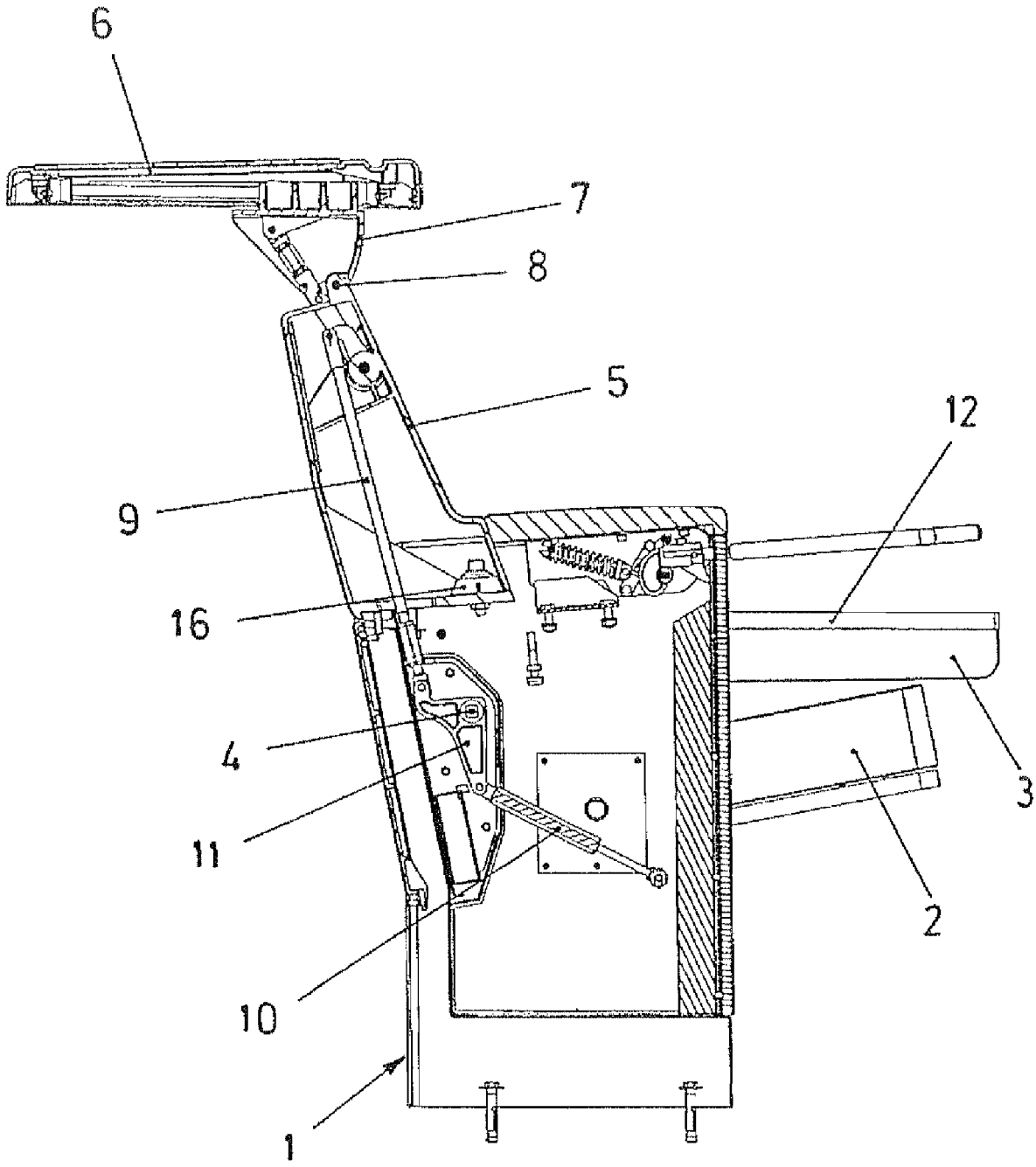
FIG. 2 shows a sectioned side view of the armchair of the invention with the table board in the unfolded position.
Figure 3:
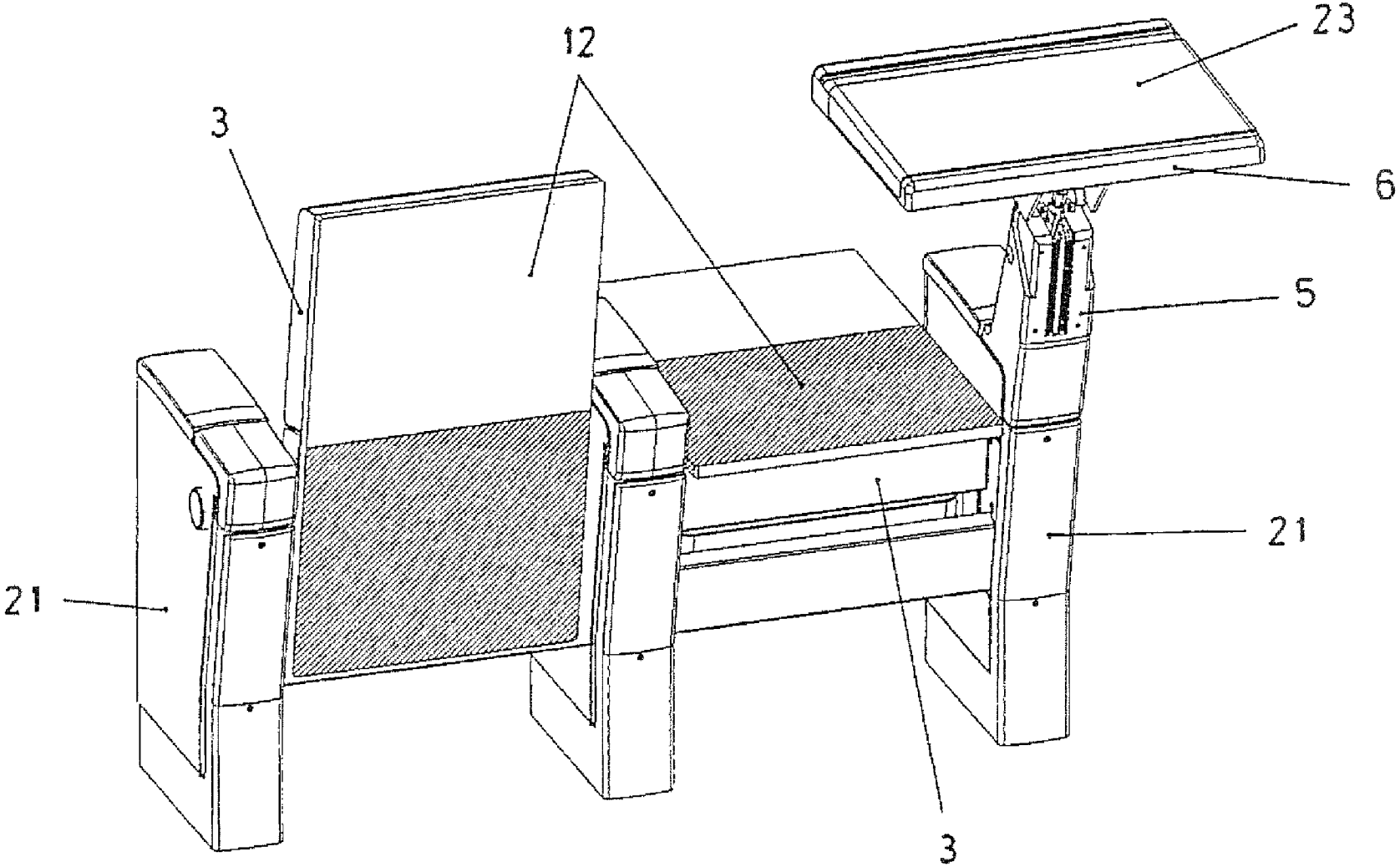
FIG. 3 shows a rear perspective view of an assembly of two consecutive armchairs, one of them with the backrest raised and the other one with the backrest lowered, only one table board being shown.

A column (5) is further incorporated in the rear part of one of the sides, a table board (6) being assembled on the upper end of said column, which table board can swivel between a vertical lowered folded position behind the backrest (3), as shown in FIG. 1, and a horizontal cantilevered position for use, as shown in FIG. 2.

The board (6) is assembled on a support (7) rotating with respect to an articulation point (8) for the swiveling, said support (7) being attached to a set of articulated connecting rods (9) moving in a rotating manner in attachment with the shaft (4) for swiveling the backrest (3).

In this manner, the swiveling movement of the board (6) is associated to the swiveling movement of the backrest (3), by means of the set of connecting rods (9), with such a relationship that when the backrest (3) is raised, the board (6) is lowered to the vertical folded position (FIG. 1) and on the contrary, when the backrest (3) is lowered, the board (6) is raised to the horizontal position for use (FIG. 2).

The set of connecting rods (9) is further attached to a shock absorbing cylinder (10) by means of a rocker (11), therefore the movement in the change from one position to another is absorbed, preventing the abruptness, insofar as the cylinder (10) also establishes a retention for the stable provisional maintenance in the two functional movement positions when its articulation with the rocker (11) surpasses the location of the rotating shaft (4) towards either side.

A plate (12) is arranged behind the backrest (12), which plate is a base for supporting objects such as briefcases, books, etc thereupon when the backrest (3) is located in the lowered position over the seat (2).

Figure 4:
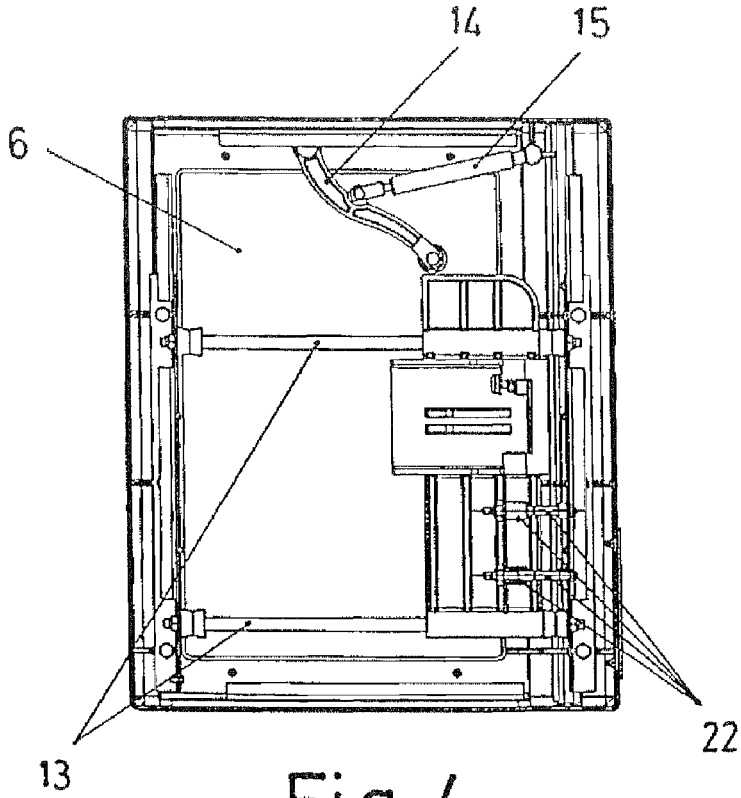
FIGS. 4 and 5 show respective lower views of the table board of the proposed armchair, in the advanced and backward positions of said board with respect to the bearing support.
Figure 5:
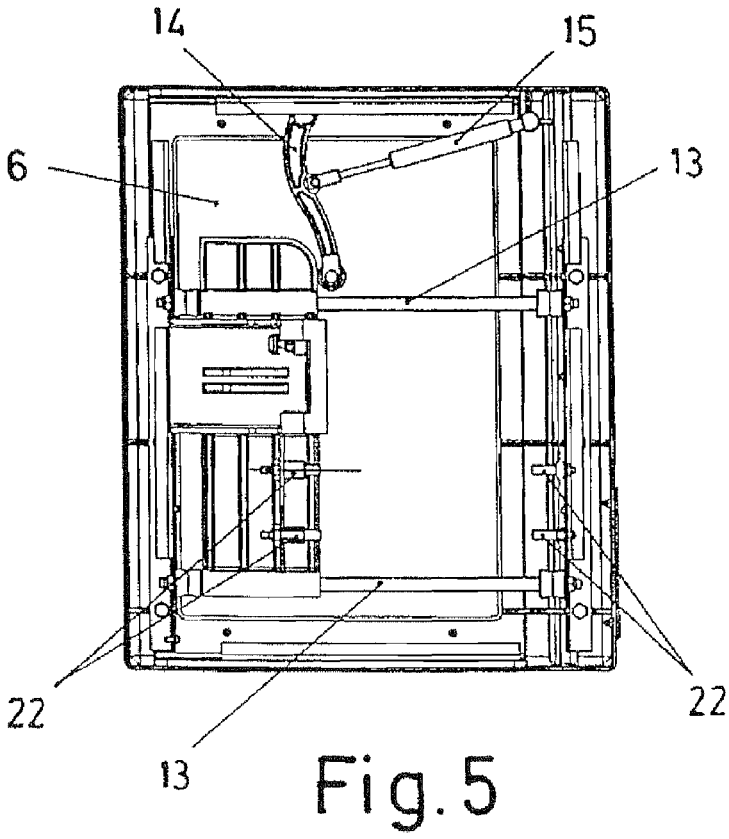
Figure 6C:
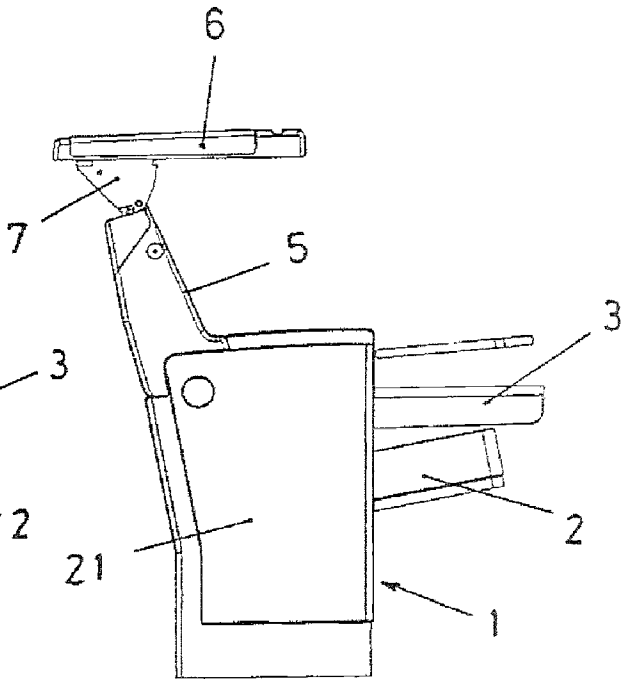
FIGS. 6A to 6C show a side view of the armchair with the table board in three movement positions between the advanced position and the backward positions.
Figure 6B:
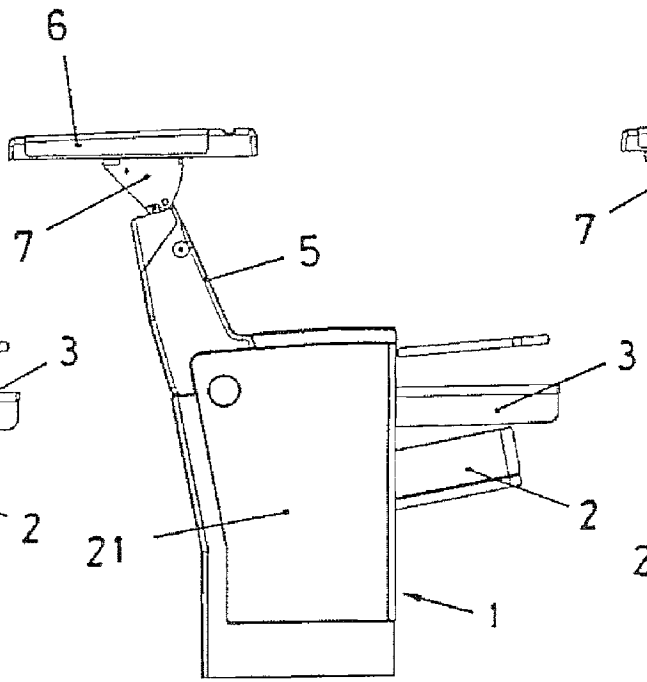
Figure 6A:
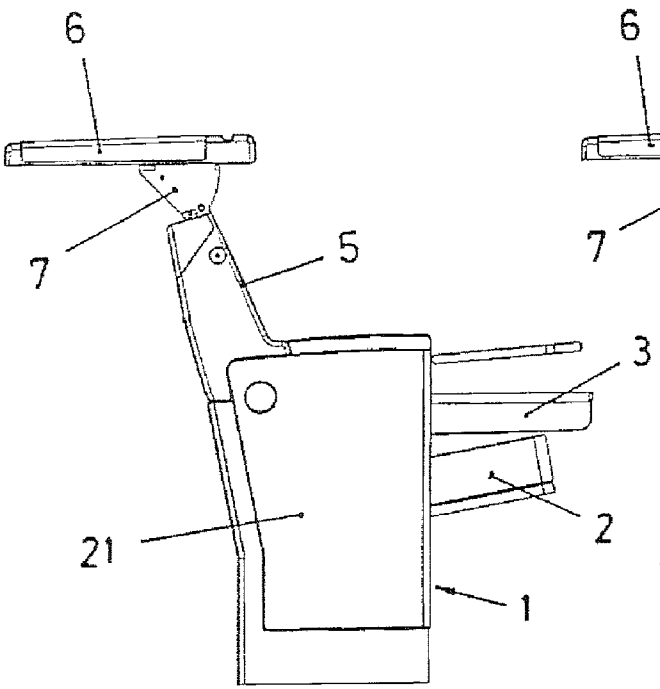

As observed in FIGS. 4 and 5, the board (6) is attached to the assembly support (7) by means of guides (13), allowing the movement of said board (6) in a forward and backward longitudinal direction in the cantilevered position, as observed in FIGS. 6A to 6C, such that the position that is moved backwards facilitates its use by a user from a rear armchair, whereas the possibility of forward movement confers an antipanic quality, because only a small push in this direction is required to withdraw the board (6), leaving the space in front of the rear armchair free, therefore the user who is seated in said rear armchair can get up and leave without any difficulties.

Said sliding movement of the board (6) on the guides (13) has a retaining device formed by a lever (14) and a pushing cylinder (15), between which a sliding support is determined against the structure supporting the board (6), as observed in FIGS. 4 and 5, therefore the sliding of the board (6) occurs with a smooth movement and stable maintenance in the end positions.

The column (5) bearing the board (6) is attached on the structure (1) of the armchair by means of a ball joint fastening (16) which allows adapting the position of the column (5) such that the board (6) is horizontal in the folded position for use, independently of the seating of the armchair on the floor.

Figure 7:
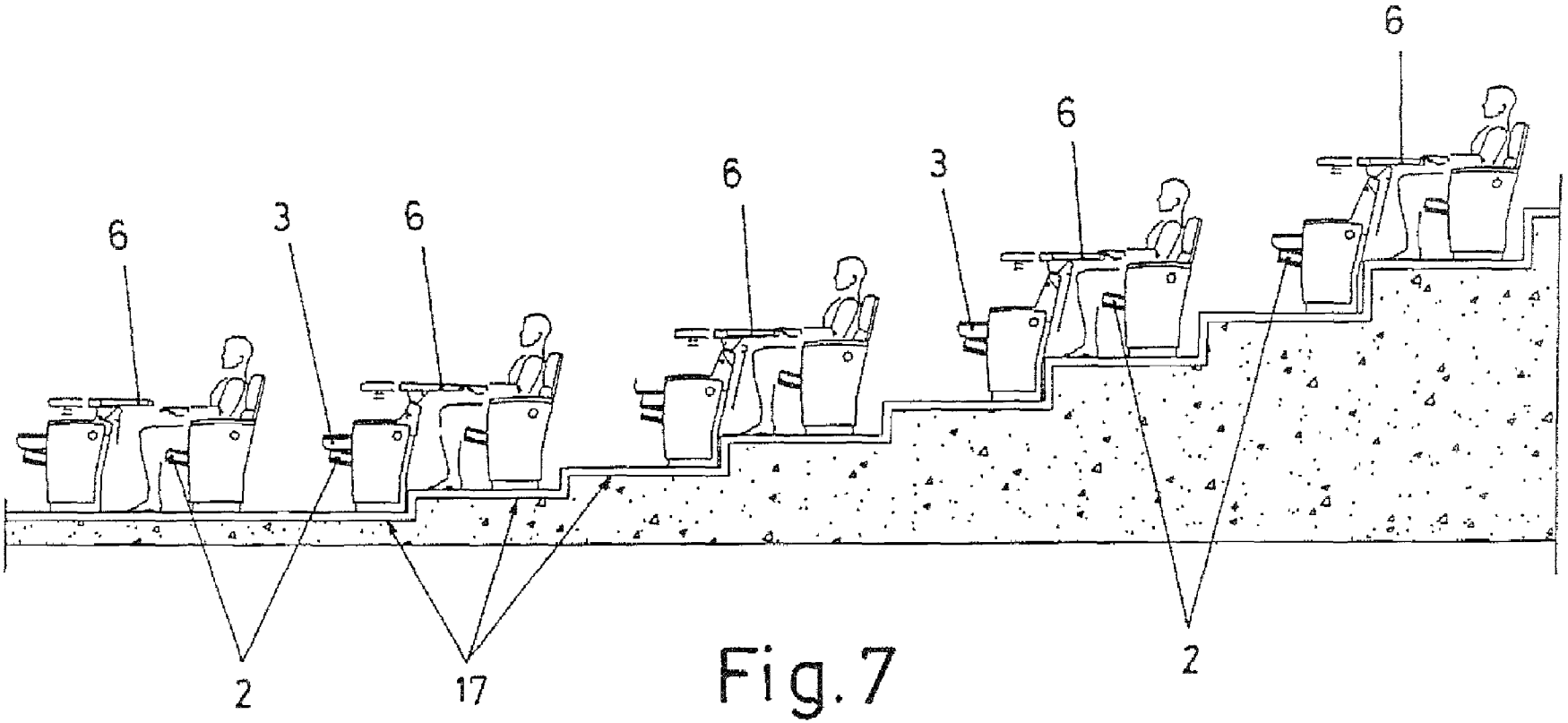
FIG. 7 shows a distribution of armchairs on the different heights of a stepped floor.
Figure 8:
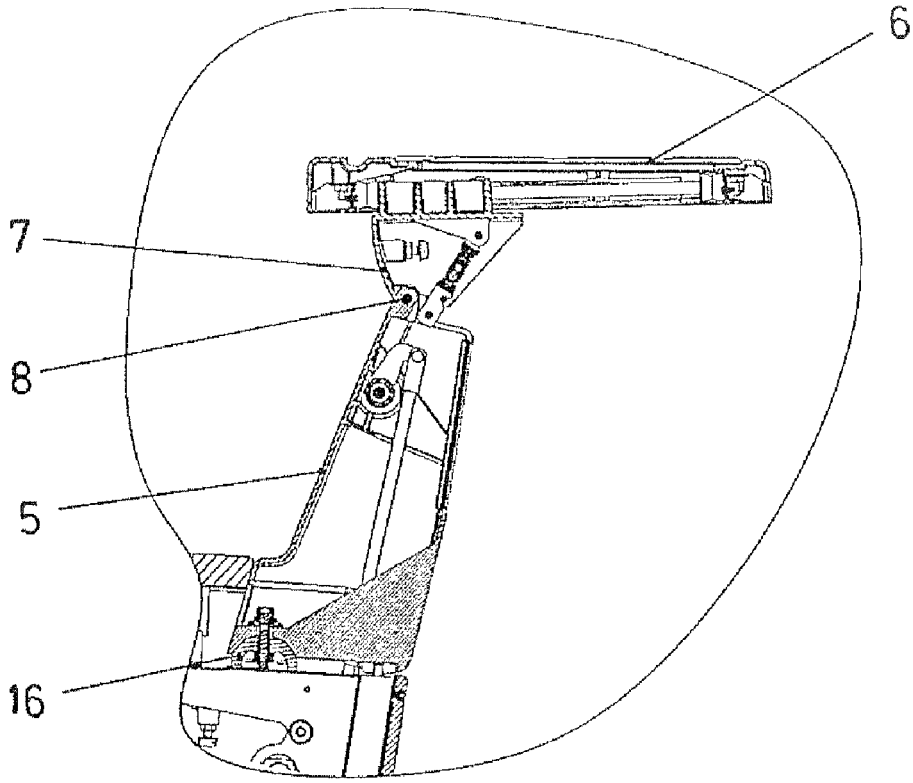
FIGS. 8 and 9 show respective details of the support of the table board in an armchair, with columns of different heights.
Figure 9:
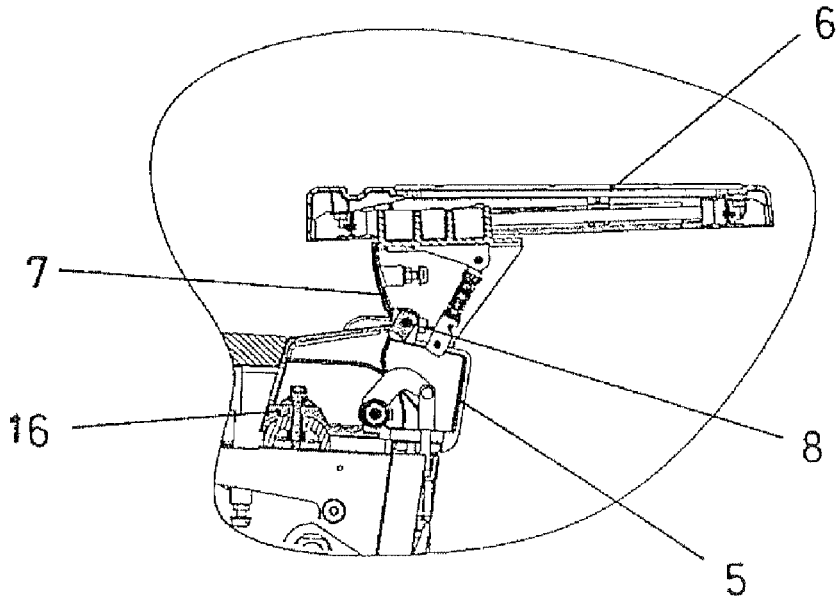

As observed in FIGS. 8 and 9, the column (5) can further be of different heights, its substitution being possible in order to adapt the height of the board (6) to the location of a rear armchair in distributions of armchairs on stepped floors (17) as shown in FIG. 7.

Figure 10:
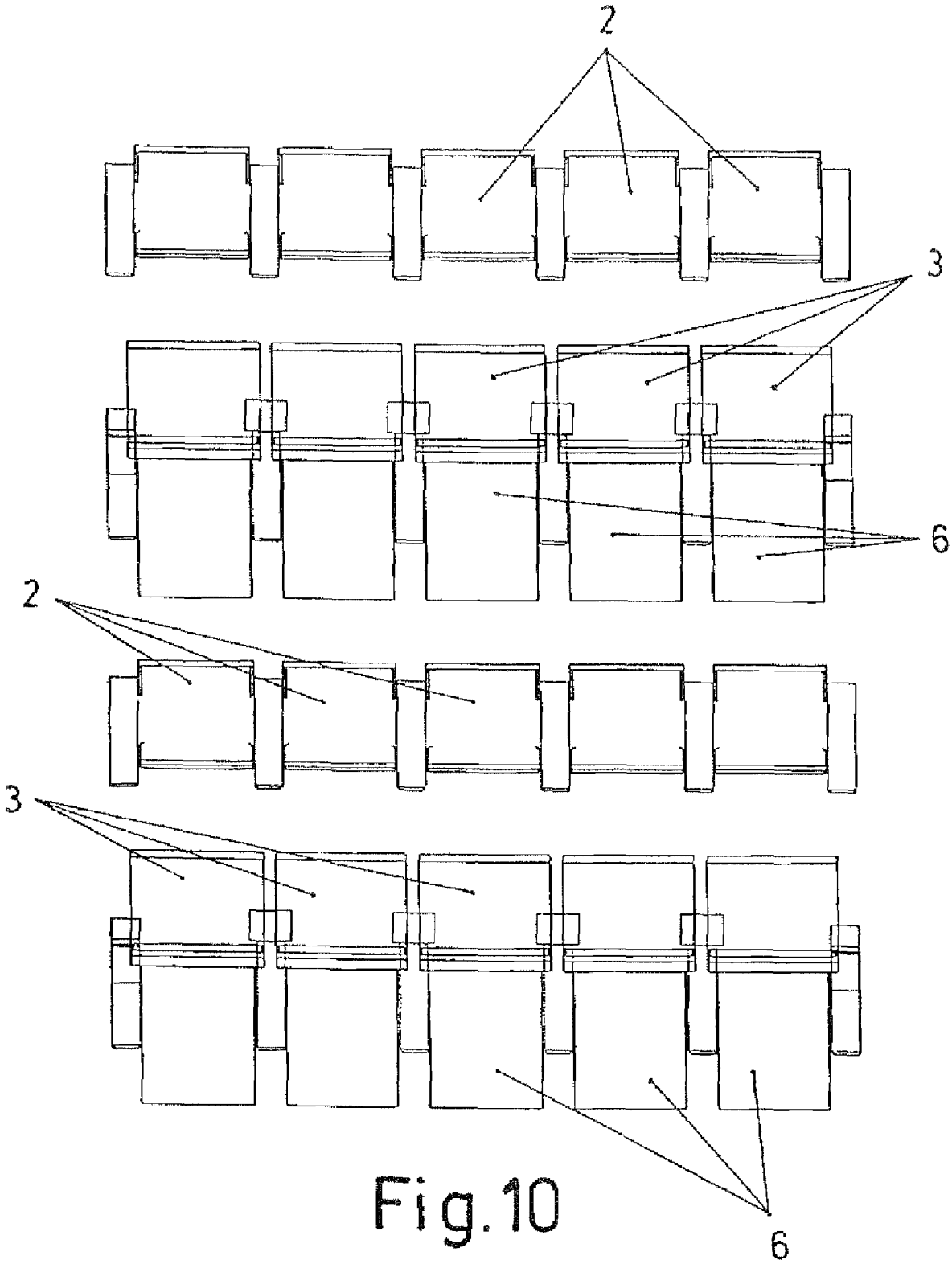
FIG. 10 shows a plan distribution of rows of armchairs, with the armchairs being aligned.
Figure 12:
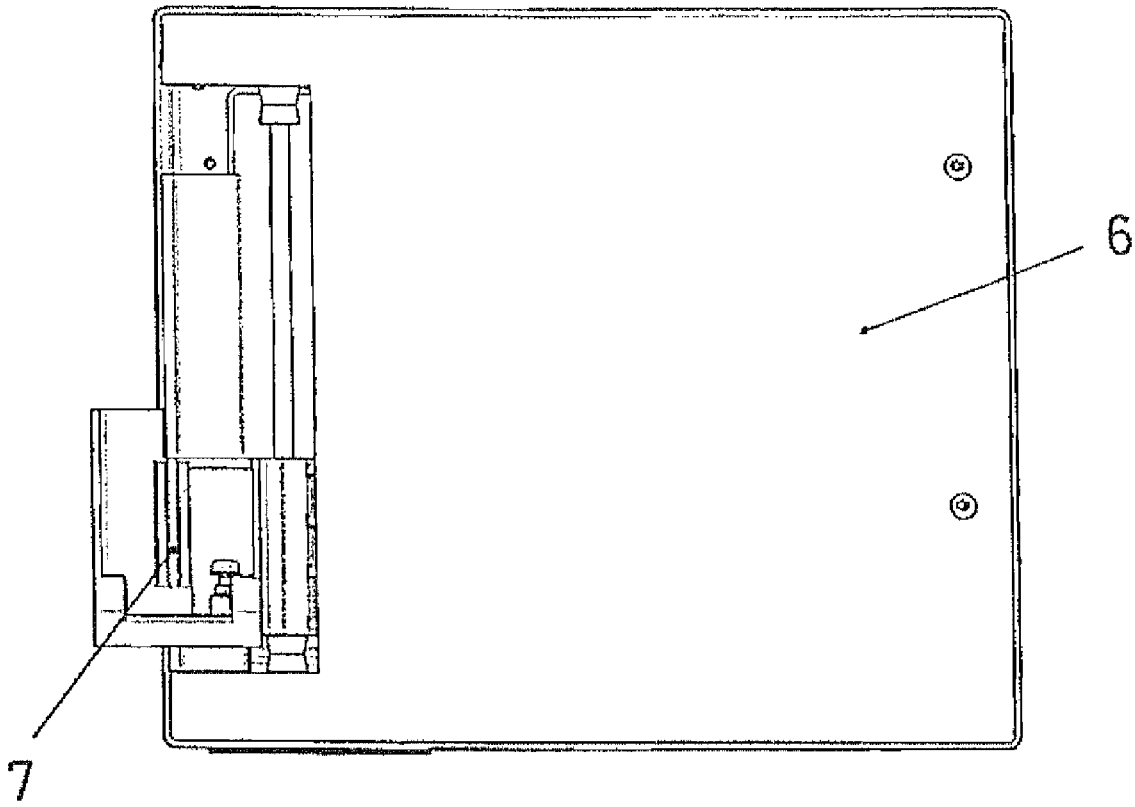
FIGS. 12 and 13 show corresponding respective lower plan and front elevational views of the table board of an armchair with the support fastening moved towards a side.
Figure 13:
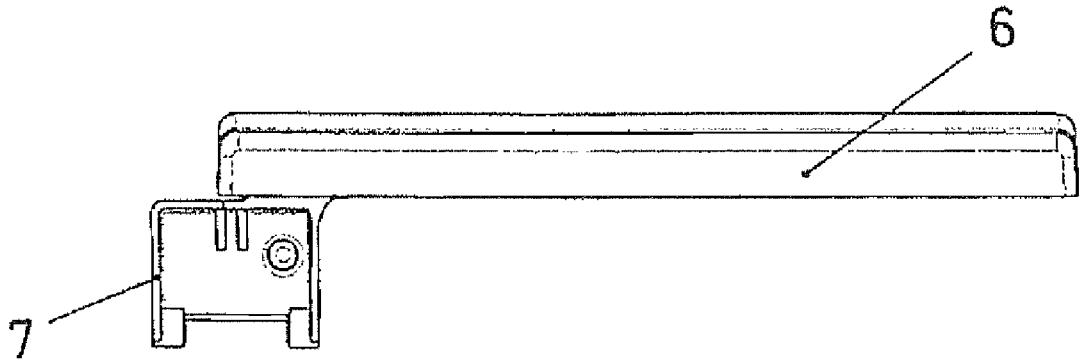

As shown in FIGS. 12 and 13, the fastening of the board (6) on the bearing column (5) can be in a position that is moved towards a side, the board (6) can therefore be centered with respect to the corresponding armchair for the distribution of armchairs in rows with the respective armchairs aligned one behind the other, as shown in FIG. 10.

Figure 11:
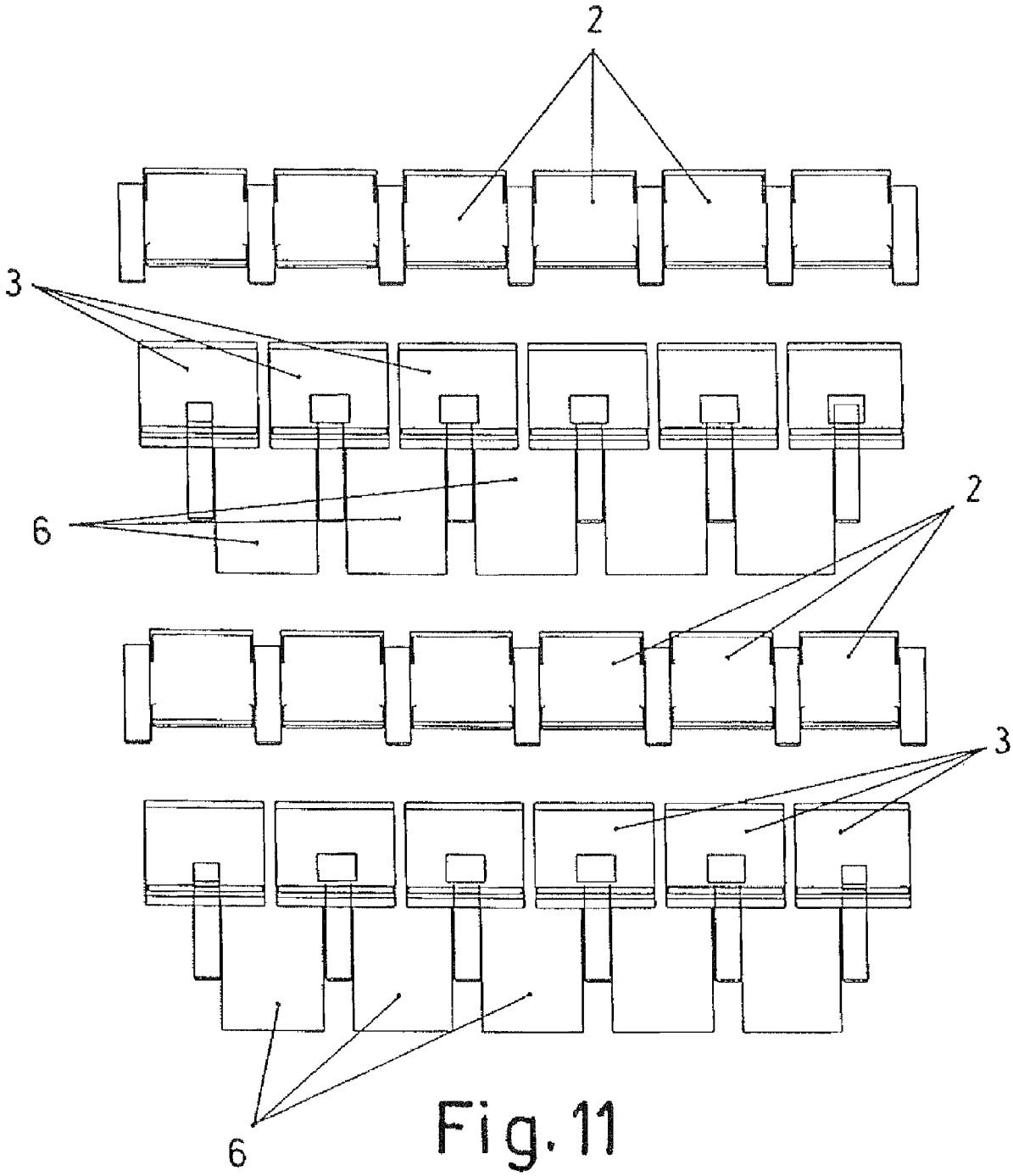
FIG. 11 shows a plan distribution of rows of armchairs, with the armchairs in a staggered formation.
Figure 14:
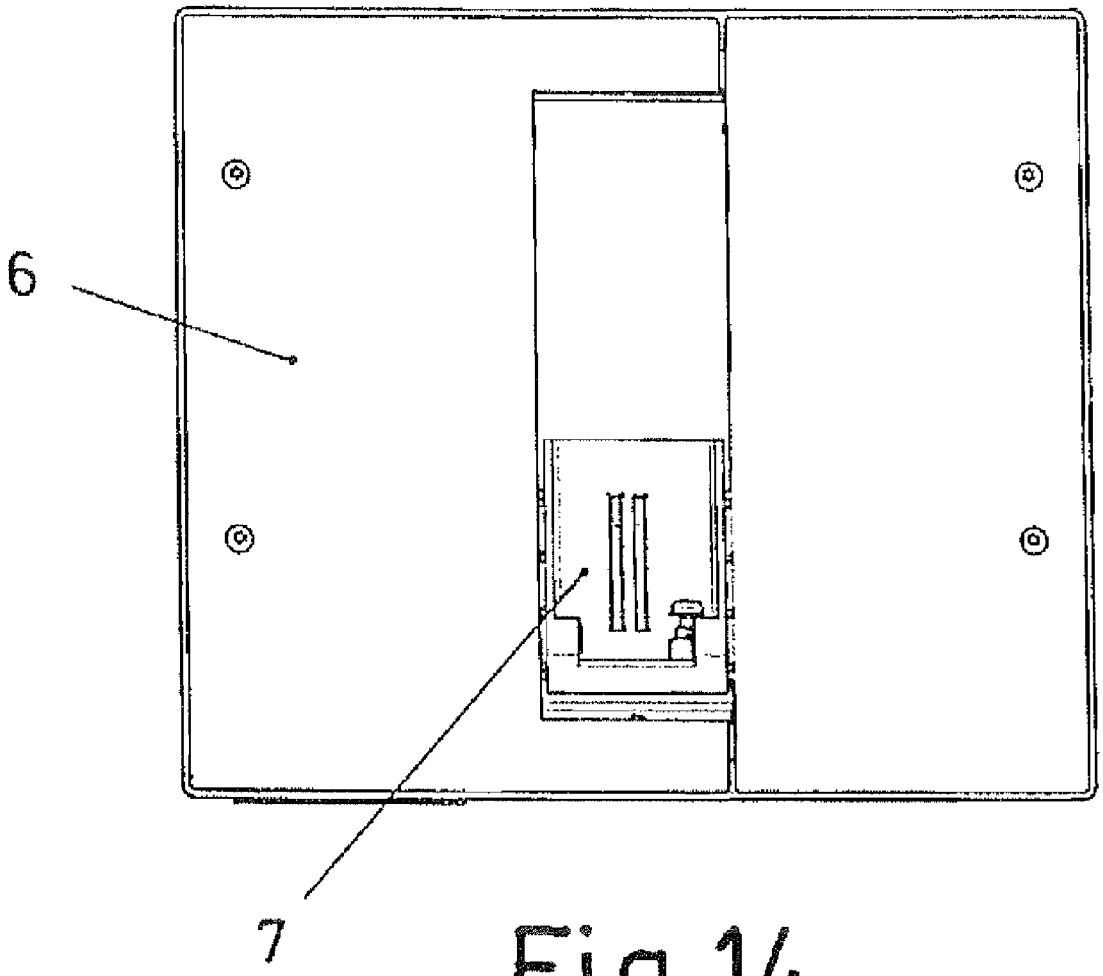
FIGS. 14 and 15 show corresponding respective lower plan and front elevational views of the table board of an armchair with the support fastening centered.
Figure 15:
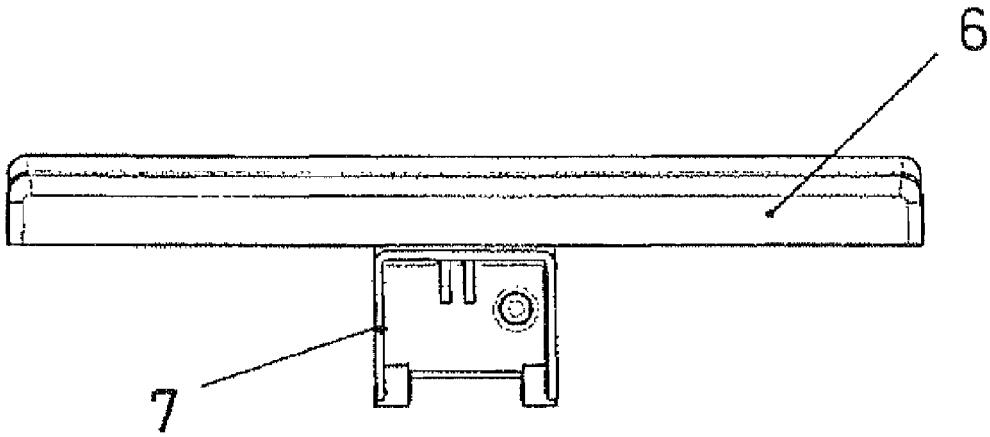

As shown in FIGS. 14 and 15, said fastening of the board (6) on the bearing column (5) can also be in a centered position, the board (6) is therefore moved towards the side with respect to the corresponding armchair in a suitable manner for the distribution of armchairs in rows with the respective armchairs in a staggered formation, as shown in FIG. 11.

Figure 16:
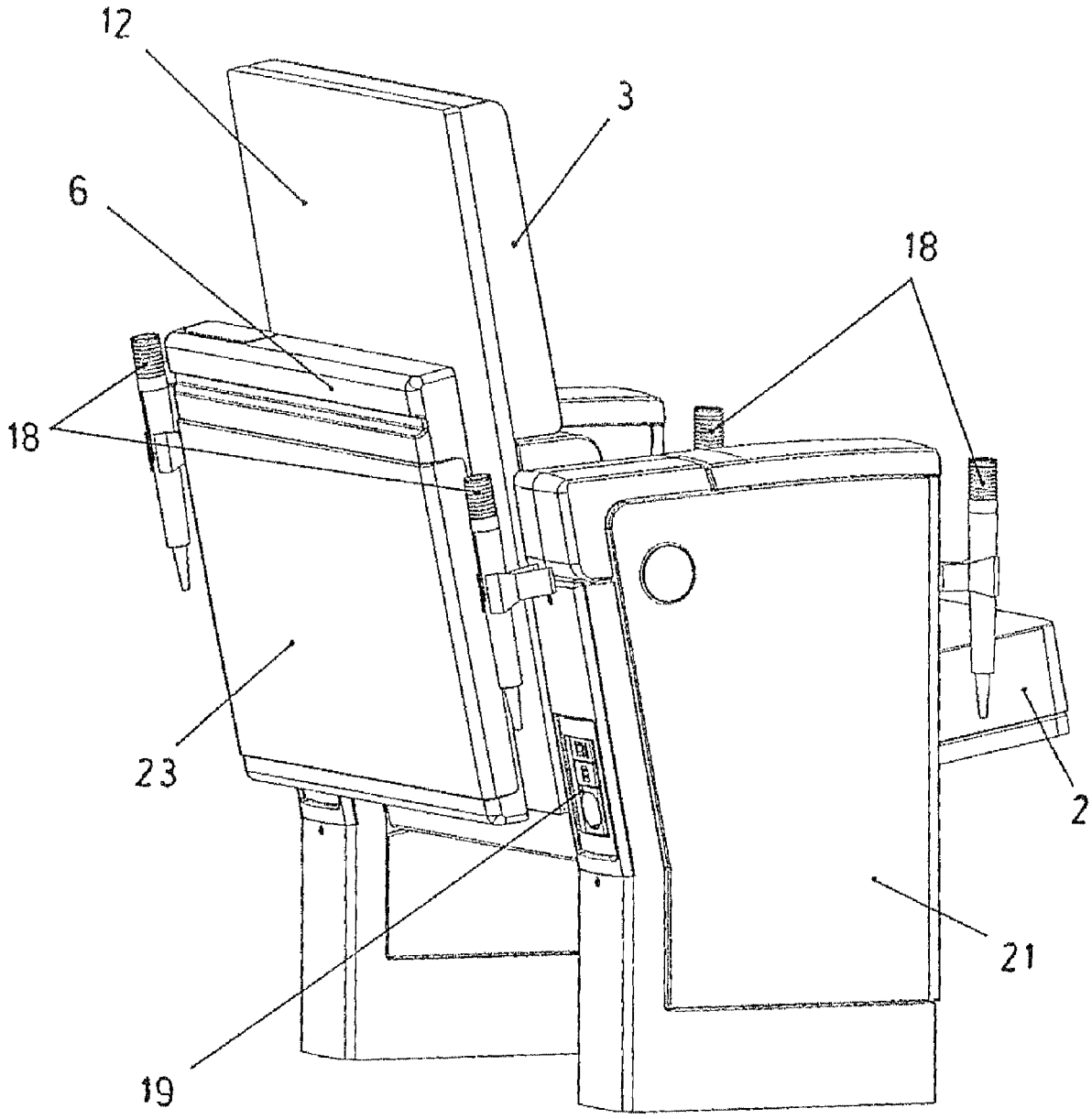
FIG. 16 shows a rear perspective view of an armchair according to the invention provided with an acoustic system and with connections.
Figure 17:
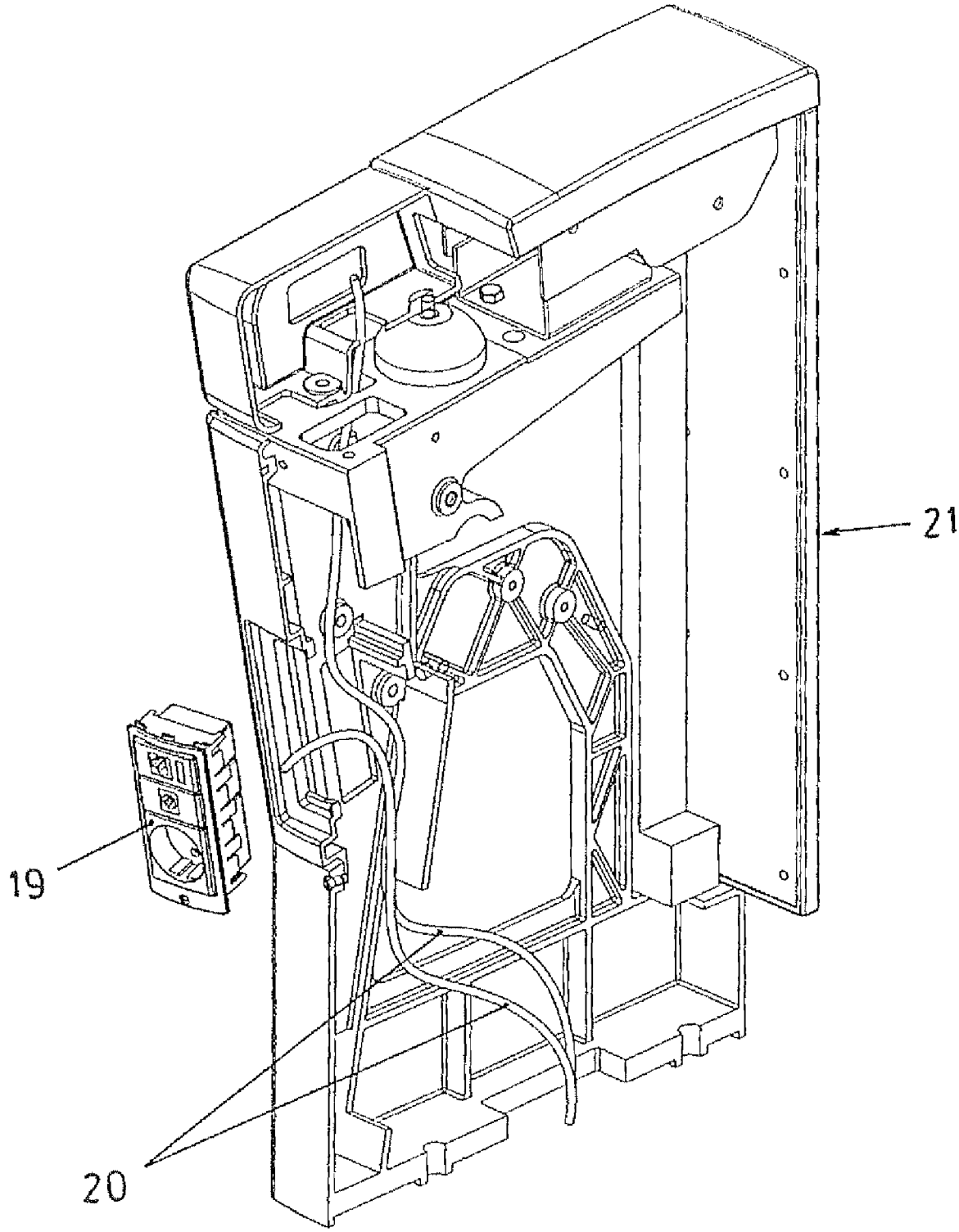
FIG. 17 shows a perspective view of the partially sectioned side of an armchair seen from the inner part, with a connection base extracted from the assembly position and the corresponding wiring in the inside.

The armchair can be equipped (FIG. 16) with an acoustic communication system by means of microphones (18) and with an installation provided with connection bases (19) for electrical, computer connections etc., an individual lighting system can also be included, the wiring (20) of said systems being incorporated inside the sides (21) of the armchair which are prepared for that purpose, as shown in FIG. 17.

The installations of the mentioned equipment systems of the armchair are provided with automatic disconnection means according to the position of the board (6), for example by means of contacts (22) which are closed when said board (6) is located in the position for use and which open disconnecting the systems when said board (6) is moved from the position for use, as shown in FIGS. 4 and 5.

The board (6) incorporates a leather upholstery (23) or the like in the face intended to remain upwards, which confers the surface of said board (6) with a suitable quality for the use as a table and particularly for writing on documents or sheets of paper using it as a support.

The invention claimed is:

1. An armchair and table assembly comprising:

a) an armchair body having a seat and a moveable backrest, the backrest movable between a raised, vertical position and a lowered, horizontal position;

b) a bearing column positioned at an arm of the armchair body and fastened to the armchair body by a ball joint;

c) a table board movably connected to the bearing column;

d) articulated connecting rods connecting the table board to the backrest so that movement of the table board between a folded vertical position and a raised horizontal position also moves the backrest between the raised and lowered position;

e) a support movably connecting the table board to the bearing column such that the table board has backwards and forwards longitudinal movement, when the table board is in the raised horizontal position; and f) the support connected to one side of the table board such that the table board opposes the backrest.

2. The armchair and table assembly according to claim 1, wherein the armchair body is equipped with an acoustic system and installations for electrical and computer connections, the wiring of which are distributed through a side of the armchair body and, an automatic disconnection mechanism by means of contacts, linked to the longitudinal movement of the table board.

3. The armchair and table assembly according to claim 1, wherein the support has guides for backward and forward longitudinal movement of the table board and a retaining device formed by a lever and a pushing cylinder.

4. An armchair and table assembly comprising:

a) an armchair body having a seat and a moveable backrest, the backrest moveable between a raised, vertical position and a lowered, horizontal position;

b) a bearing column positioned at an arm of the armchair body and fastened to the armchair body by a ball joint;

c) a table board movably connected to the bearing column;

d) articulated connecting rods connecting the table board to the backrest so that movement of the table board between a folded vertical position and a raised horizontal position also moves the backrest between the raised and lowered position;

e) a support movably connecting the table board to the bearing column such that the table board has backwards and forwards longitudinal movement, when the table board is in the raised horizontal position; and f) the support connected in a middle area of the table board such that the table board is staggered from the backrest.

5. The armchair and table assembly according to claim 4, wherein the armchair body is equipped with an acoustic system and installations for electrical and computer connections, the wiring of which are distributed through a side of the armchair body and, an automatic disconnection mechanism by means of contacts, linked to the longitudinal movement of the table board.

6. The armchair and table assembly according to claim 4, wherein the support has guides for backward and forward longitudinal movement of the table board and a retaining device formed by a lever and a pushing cylinder.

* * * * *